United States Patent [19]

MacElvain

[11] Patent Number: 4,520,879

[45] Date of Patent: Jun. 4, 1985

[54] RATCHET AND HYDRAULIC SEAL ASSEMBLY FOR ROTATING HOLLOW SHAFTS

[75] Inventor: Robert C. MacElvain, Eufaula, Ala.

[73] Assignee: Deep Rock Manufacturing Company, Inc., Opelika, Ala.

[21] Appl. No.: 384,892

[22] Filed: Jun. 4, 1982

[51] Int. Cl.[3] ..... E21B 1/00

[52] U.S. Cl. ..... 173/57; 173/73; 285/190; 74/575; 81/177.1

[58] Field of Search ..... 173/57, 73; 285/39, 285/190; 74/575; 145/70, 76; 175/207

[56] References Cited

U.S. PATENT DOCUMENTS

| | | | |
|---|---|---|---|
| 1,025,333 | 5/1912 | Terry | 175/207 |
| 2,594,443 | 4/1952 | Johnston | 74/575 X |
| 3,204,707 | 9/1965 | Johnson | 173/57 |
| 3,277,972 | 10/1966 | Lagerstrom | 285/190 X |
| 3,610,348 | 10/1971 | Brooks | 175/207 |
| 3,814,193 | 6/1974 | Schneider | 173/157 |

FOREIGN PATENT DOCUMENTS

| | | | |
|---|---|---|---|
| 2155503 | 5/1973 | Fed. Rep. of Germany | 285/39 |

*Primary Examiner*—E. R. Kazenske
*Assistant Examiner*—Willmon Fridie, Jr.
*Attorney, Agent, or Firm*—Newton, Hopkins & Ormsby

[57] ABSTRACT

A power transfer pipe, surrounded by an elastomeric, self lubricating seal assembly, transfers rotational power in one direction from a prime mover, at the upper end of the power transfer pipe, to a threadedly secured, hollow, drill pipe at the lower end, the seal assembly directs fluid from the sleeve into the drill pipe. A ratchet assembly at the upper end of the power transfer pipe, facilitates the disengagement of the power transfer pipe from the drill pipe.

2 Claims, 3 Drawing Figures

RATCHET AND HYDRAULIC SEAL ASSEMBLY FOR ROTATING HOLLOW SHAFTS

BACKGROUND OF THE INVENTION

1. Field of the Invention

This invention relates to an apparatus for delivering both rotation force and fluid to a hollow shaft and is more particularly concerned with a ratchet and hydraulic seal assembly for rotating hollow shafts.

2. Description of the Prior Art

In the past, drilling rigs for drilling for oil, gas, or water have employed drilling pipes which are successively connected together so as to form a power train which rotates a drilling bit and urges the drilling bit progressively into the ground. In doing so, both rotational force and a down force is applied to the upper end portion of the uppermost pipe. Drilling fluid, such as water or "mud" is usually pumped through a metal sleeve and through ports in a power transfer pipe so that this drilling fluid passes down through the tandem arranged drill pipes and out around the drill bit so as to lubricate the drill bit and also provide a return fluid which washes out or flushes the drill hole as it passes externally of the drill rods up and out of the drill hole.

The difficulty with the prior art hydraulic seal assemblies is that they readily wear and are subjected to the abrading drilling fluid. Thus, in use, these hydraulic seal assemblies leak.

SUMMARY OF THE INVENTION

Briefly described, the present invention includes a power transfer pipe which is hollow along its shank and lower end portion and is provided at this lower end portion with external threads. The upper end portion of the pipe is provided with a hexagonal head for receiving an open-ended wrench and is provided at its uppermost end with peripheral splines or teeth, engaged by a spring loaded ratchet pawl carried by a ratchet ring. The upper end also has a socket which receives the end of a drive shaft which extends from the prime mover. A shear pin holds the drive shaft in place.

The central portion or shank of the power transfer pipe is provided with circumferentially spaced ports, around which extends the chamber of a self-lubricated elastomeric hydraulic seal assembly having a sleeve provided with integrally formed inner and outer seal rings at both ends. A conduit, protruding from the side of the sleeve, receives the drilling fluid which is directed by the sleeve around the shank, through the ports in the power transfer pipe and, thence, down through its interior into the drilling pipes. The sleeve is preferably made of hard rubber with internally incorporated lubricants.

Accordingly, it is an object of the present invention to provide a ratchet and hydraulic seal assembly for rotating hollow shafts, which assembly has a long useful life.

Another object of the present invention is to provide a ratchet and hydraulic seal assembly for rotating hollow shafts, which assembly is inexpensrve to manufacture, durable in structure and efficient in operation.

Another object of the present invention is to provide a ratchet and hydraulic seal assembly for rotating hollow shafts, which assembly can be taken apart by hand and has parts which may be readily assembled and disassembled.

Another object of the present invention is to provide a sleeve assembly for the power transfer pipe of a hydraulic rotary drill, the sleeve assembly being inexpensive and being readily and easily cast.

Another object of the present invention is to provide a hydraulic seal assembly which will not readily leak.

Other objects, features and advantages of the present invention will become apparent from the following description when taken in conjunction with the accompanying drawing wherein like characters of reference designate the corresponding parts throughout the several views.

DESCRIPTION OF THE PREFERRED EMBODIMENTS

Figures 2, 3:
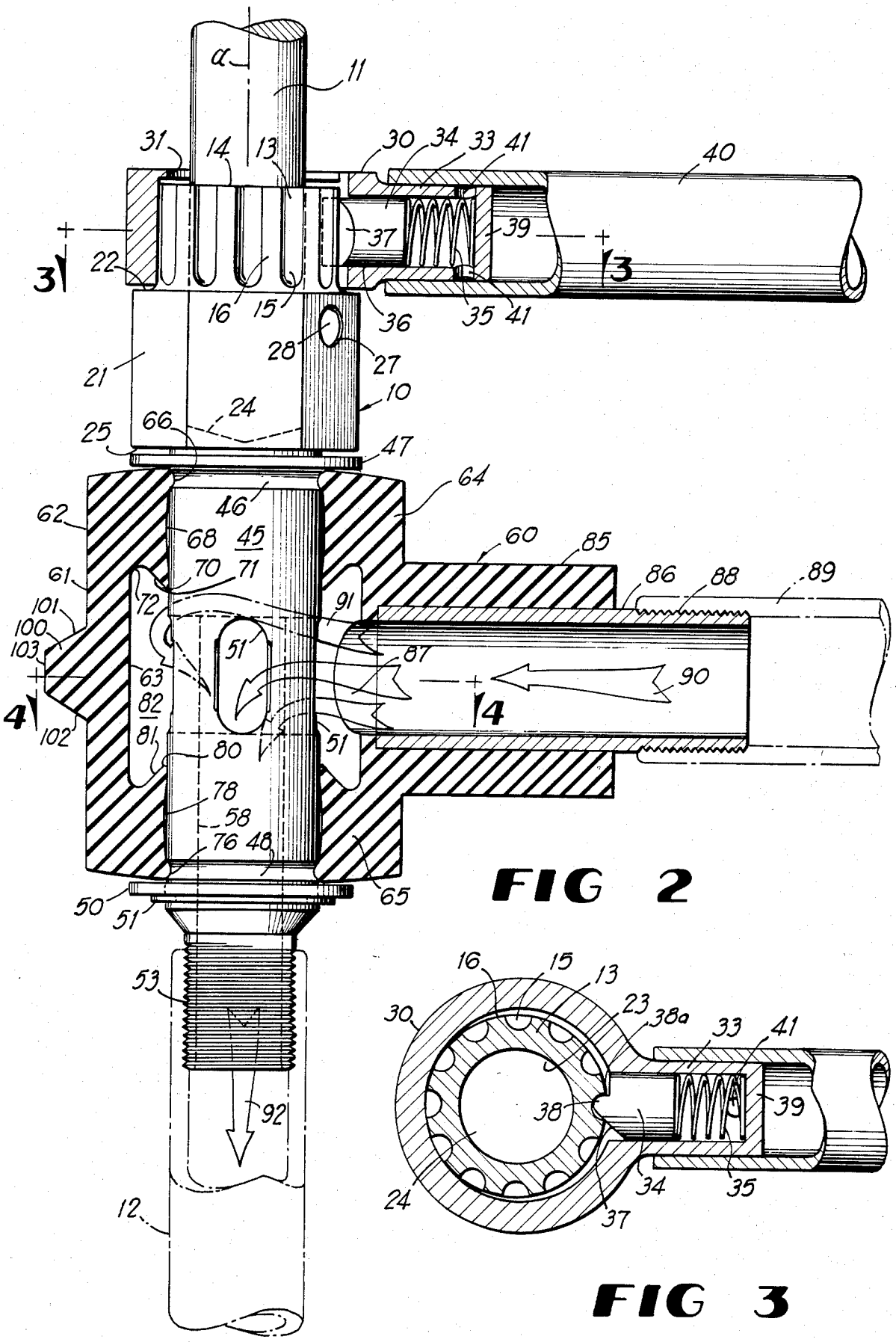
FIG. 2 is a partially broken away side elevational view of the ratchet and hydraulic seal assembly depicted in FIG. 1, the assembly being attached to a shaft, leading from a prime mover, the assembly being illustrated attached at its upper end to a drill shaft and at its lower end to a drill pipe depicted in broken lines.
FIG. 3 is a cross-sectional view taken substantially along line 3—3 in FIG. 2

Referring now in detail to the embodiment chosen for the purpose of illustrating the present invention, numeral 10 denotes generally the power transfer pipe or shaft, through which power is delivered from the shaft 11 of a prime mover, such as a drilling rig engine (not shown), to the coupled portion or lower end portion of a drill pipe or drill rod 12, as illustrated rn FIG. 2. It will be understood that the conventional drilling rig (not shown) will apply both a rotational force to shaft 11 and a down pressure thereon so as to urge the drill pipe 12 and the other drill pipe (not shown) which extend from the drill pipe 12 and are connected in tandem and to a drill bit (not shown) at the lowermost end, so as to force the drill bit downwardly as the drill bit is rotated.

In more detail, the power transfer pipe 10 includes, at its upper end, a peripherially splined or externally toothed ratchet ring 13 concentrically arranged along axis $\alpha$ of the power transfer pipe 10. In more detail the ratchet ring 13 is a hollow cylindrical member provided with a flat or planar radially extending upper surface 14. Its periphery is provided with a plurality of circumferentially equally spaced concaved axially extending grooves 15. The grooves 15 are concaved in cross section and open upwardly, extending to the upper surface 14. Between the grooves 15 are the circumferentially, equally spaced, peripheral splines or teeth 16 which also extend axially.

Formed integrally with the ratchet ring 13 and disposed therebelow is a hexagonal block 20 which has flat rectangular surfaces 21 spaced circumferentially around this block. Thus, the block 20 forms a hexagonal nut which can receive an open ended wrench for rotating. The hexagonal head or block 20 is of larger diameter than the diameter of the ratchet ring 13 and therefore, there is provided a radial shoulder 22 along the upper edge portion of the block 20 which protrudes outwardly of the ratchet ring 13. An axial bore 23 extends from the upper surface 14 inwardly throughout the height of the ratchet ring 13 and throughout substantially the height of the block 20 to terminate, as illustrated by broken lines 24, in the vicinity of the bottom surface 25 of the block 20. The ring 13 and block 20 form a socket, the bore 23 of which receives the drive shaft 11 so that the drive shaft 11 rotates the power transfer pipe 10. A radial hole is provided in the shaft 11 which is alignable with a diametrically extending hole 27 in the block 20. For removeably securing the end of the drive shaft 11 within the bore 23 a shear pin 28, extends through the holes and locks the two members together.

Received on top of the ratchet ring 13 is a removeable ratchet cap 30. This cap 30 is a hollow, tubular, cylindrical member of a diameter slightly larger than the diameter of the ratchet ring 13. The upper end portion of the cap 30 has a inwardly protruding, circumferential lip or top flange 31 which, when the cap 30 is fully inserted onto the ring 13, abuts against the peripheral area of the upper surface 14 to limit the downward movement of the cap 30 and close the upper ends of the grooves 15. The height of the cap 30 is approximately equal to the height of the ratchet ring 13 and, therefore, the cap 30 covers the grooves 15 and the teeth 16 but terminates above shoulder 22.

Figure 1:
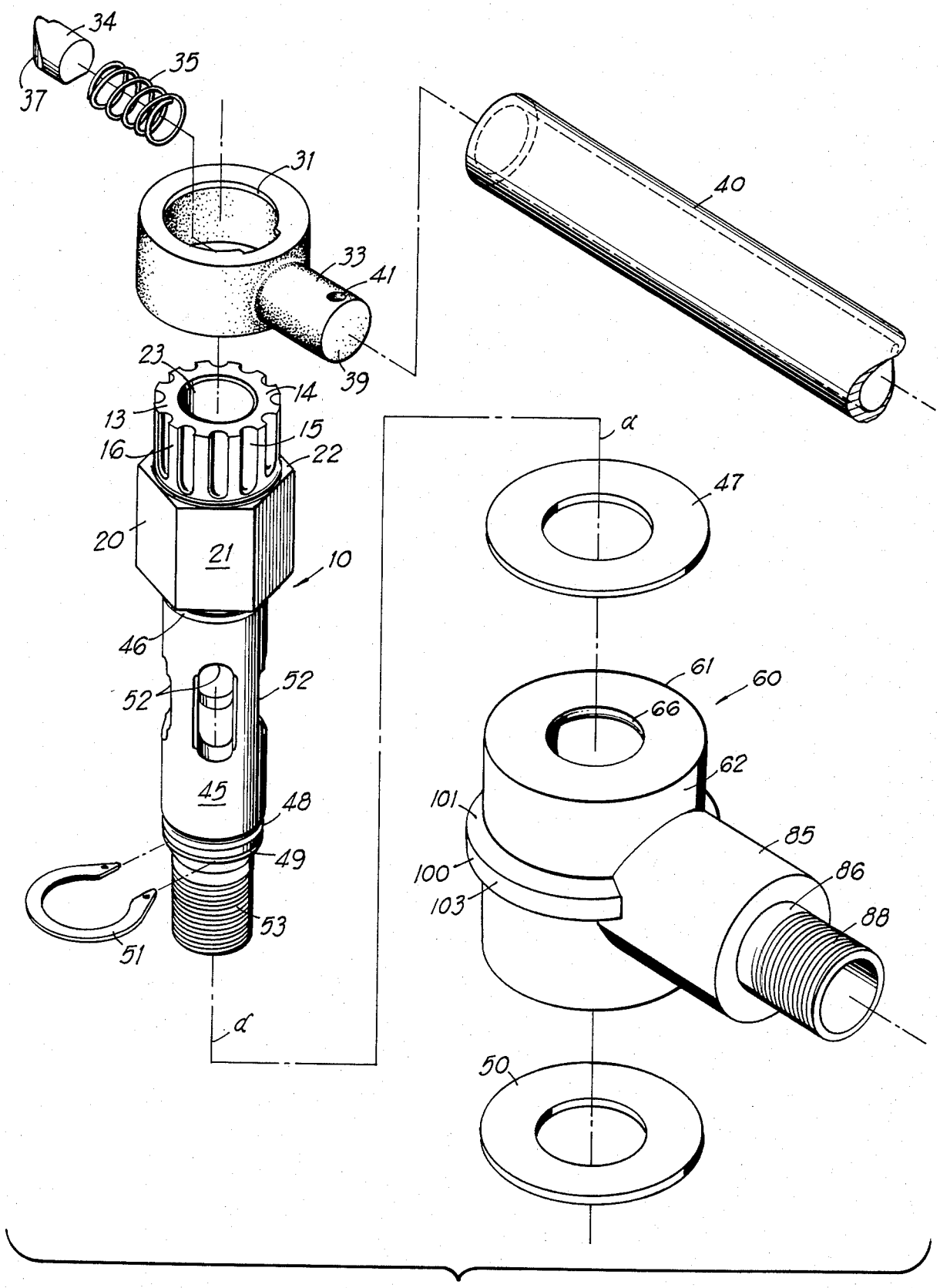
FIG. 1 is an exploded perspective view of a ratchet and hydraulic seal assembly for rotating hollow shafts, constructed in accordance with the present invention.

Protruding radially from the central portion of the cap 30 is a cylindrical lever arm and spring housing 33 which protrudes radially from the central portion of the cap 30, the lever arm 33 serving a double function of providing a means by which the cap 30 is manually rotated and providing a housing for the ratchet pawl 34 and its spring 35. In more detail, the arm 30 is a hollow, tubular, cylindrical radially extending member, closed at its outer end by end plate 39 and communicating at its inner end with the interior of the cap 30. Received within the interior of the arm 33 is a coil spring 35 of a diameter slightly smaller than the inside diameter of arm 33. One end of the coil spring 35 acts against the end plate 39 and the other end of the coil spring 35 abuts the outer surface of the ratchet pawl 34. Ratchet pawl 34, as seen in FIG. 1, has an essentially cylindrical sidewall or surface which is flattened along its bottom portion as indicated at numeral 36. Likewise, the interior of the arm 33 is flattened so as to form a surrounding contour for the pawl 34 permitting the pawl 34 to move axially but arrests the pawl 34 from rotational movement.

The inner end pawl 34, at one side is provided with a flat camming surface 37 which extends in an angular direction with respect to the axis of the pawl 34, as seen in FIGS. 1, 2 and 3. The camming surface 37 terminates at the central inner end portion of the pawl 34 and is merging with a transverse concaved tip 38 extending diametrically across the end.

The remainder of the tip 38 has a radial front driving surface 38*a*. The convexed surface of the tip 38 corresponds generally with the diameter of the concaved recesses 15 in the ratchet ring 13, whereby the tension of spring 35 against the back surface of pawl 34 yieldably urges the pawl 34 toward the ratchet ring 13 and the tip 38 into a groove 15, when the groove 15 and the tip 38 are in registry. The angling camming surface 37 will be urged out of the recess 15 when clockwise motion is applied to the cap 30, as viewed in FIG. 3. Counterclockwise motion (as viewed in FIG. 3) of the cap 30 will cause the pawl 34 to engage in a recess 15 and thereby rotate the ring 13 and hence pipe 10 with the cap 30.

It will be seen that the outer surface of the arm 33 is cylindrical so that it is readily received in the hollow, tubular, cylindrical end portion of a pipe shaped lever handle 40, seen in FIG. 1. The pipe 40, however, is removeable from the arm 33. Holes 41 in the end of arm 33 permit the interior of the arm 33 to breath as the pawl 34 is moved inwardly and outwardly therein.

It is now seen that the ratchet socket portion of the assembly assures that, when the cap 30 is rotated, it will only rotate the pipe 10 to unscrew the pipe 10 from the drill pipe 12.

Below the head or block 20, the power transfer pipe 10 is provided with a hollow, cylindrical central shank 45 which protrudes downwardly from the block 20 and is of a smaller diameter than the block 20. This hollow, cylindrical shank 45 has an upper peripheral or circumferential groove 46 at its upper end, the groove 46 being spaced slightly below the lower surface of block 20. A flat upper annular washer 47 optionally fits into the space between the bottom surface 25 of block 20 and the groove 46, as seen in FIG. 2.

The bottom portion of the shank 45 is provided with a lower peripherial or circumferential groove 48, while the lower extremity of the shank 45, below groove 48, is provided with a third or lowermost circumferential groove 49. This groove 49 receives a horseshoe shaped, retainer snap ring 50. As is usual, the snap ring 51 can be readily removed, when desired.

In the space between the groove 48 and the groove 49, the shank 45 is optionally provided with a lower flat annular washer 50.

Within the central portion of the shank 45, there are four circumferential, equally spaced, fluid ports 52 which communicate with the hollow and lower interior of the pipe 10. These ports 52 are elongated along the major axis $\alpha$.

The lower end portion of the pipe 10 is tubular and is provided with external threads 53 which receive the internal threads of each of the drill pipes 12, as the drill pipe 12 is installed for driving action. The hollow interior of the lower portion of pipe 10 communicates with the interior of shank 45.

It is now seen that in the power transfer pipe 10 there is a partition which separates the bore 23 from the hollow interior 54 of the shank so that any liquid entering the interior 54 via the ports 52 will be directed down through the hollow interior of the drill pipes 12.

According to the present invention, a hollow, self lubricating, integral, molded, elastomeric, sleeve assembly, denoted generally by numeral 60, surrounds the shank 45. The elastomeric portion of sleeve assembly 60 is composed of an elastomer in admixture with a lubricant or lubricants. One suitable formulation for the sleeve assembly 60 is found in Table 1 below.

TABLE 1

93%+ gum rubber
5% flake graphite
less than 1% powdered teflon
less than 1% molybdenum disulfide.

If desired, up to 5% of a commercial internal lubricant filler may be added to the gum rubber composition of Table 1. It will be understood that the ingredients listed above can be modified, as desired, however, preferably the ingredients should contain less than about 10% graphite, less than about 1% teflon and less than about 1% molybdenum disulfide.

The body 61 of the sleeve assembly 60 is a hollow, tubular, cylindrical member of a diameter substantially larger than the diameter of the shank 45. The height of the body 61 is slightly greater than the distance between the grooves 46 and 48. The body 61 has a cylindrical outer surface 62 and a cylindrical central inner surface 63, both of which are concentric with and spaced from and extend around the shank 45. The body 61, has, integrally formed therewith, an upper seal member 64 and a lower seal member 65, these seal members 64 and 65 being respectively at the upper and lower end portions of the body 61. Both seal members 64 and 65 are substantially identical and complementary with respect to each other. The seal member 64, includes an inwardly protruding upper outer seal 66, having an inner convex radius in cross-section which conforms generally to the radius of the concaved groove 46 while its diameter about axis $\alpha$ is slightly less than the diameter of groove 46, so that outer seal 66 is received in tension in the groove 46. Below or inwardly of the upper outer seal 66, the inner periphery of the upper seal member 64 is slightly concaved in cross-section, as indicated at numeral 68. This concave central portion 68 therefore, while surrounding the upper end portion of the shank 45, has its central portion spaced away from the periphery of shank 45.

At the lower extremity of the upper seal member 64, there is an inner upper circumferential seal 70, the inner surface of which merges with the lower edge of the concaved central peripheral portion 68. This circumferential inner seal 70, in cross-section has a rounded lower tip and merges with an upwardly and outwardly extending surface 71 which, in turn, merges into a concaved radius 72 which merges with the upper edge of the cylindrical surface 63.

In like fashion, the lower seal member 65 is provided with a lower or outer seal 76 which is received under tension in the lower groove 48. This lower outer seal 76 has an inner surface which, like the inner surface of seal 68 is convex and surrounds the lower end portion of the shank 45. The lower seal member 65 is provided, at the upper end with an inner circumferential seal 80 formed in cross-section by the converging walls of the concaved surface 78 and the inclined surface 81.

Thus, an essentially symetrical body 61 is provided, having spaced outer seals 66 and 76 and spaced inner seals 70 and 80 which encircle the shank 45, the outer seals 66 and 76 being received in grooves 46 and 48 respectively and the inner seals 70 and 80 riding in tension along the periphery of the shank 45 above and below the ports 51, respectively. The body 61, therefore, defines an inner annular hollow chamber 82 which surrounds the port area of ports 51, in the central portion of the shank 45.

Integrally joined to the body 61 is a sidewise outwardly protruding or radially extending elastomeric collar 85, the outer portion of which surrounds the inner portion of a hollow, cylindrical, tubular, open-ended, coupling pipe 86. This inner and central portion of coupling pipe 86 is joined by vulcanization to the inner periphery of collar 85 which surrounds it so that the inner and central portion of the pipe 86 is fixed by its outer periphery to the inner periphery of collar 85. The inner end of pipe 86 abuts an inner annular shoulder 87 of collar 85 and thus terminates in spaced relationship to the chamber 82 but communicates therewith through shoulder 87. Thus, the pipe 86 is concentric with the collar 85 and extends radially outwardly from the body 61. The outer extremity of the pipe 86 is provided with external threads 88 on which is threadedly received the discharge end of a flexible tube or hose 89, shown in broken lines in FIG. 2.

The mud or drilling fluid is pumped through the hose 89 and into the pipe 86 in the direction of the arrow 90. This fluid, thence, passes through the annular opening in shoulder 87 and into the chamber 82, whence it passes inwardly through the various ports 51, as indicated by the arrows 91 and thereafter downwardly through the hollow interior 54 of the lower portion of the power transfer pipe 10, passing into the drill pipe or drill rod 12, as indicated by arrow 92. Usually about 60 to 100 psi pressure is generated as the liquid is pumped into the chamber 82. Seals 70 and 80 seat with pressure of the drilling fluid. This is accomplished because the internal pressure in chamber 82 acts on the inclined surfaces 70 and 81 to tend to flex them inwardly and, thereby urge the inner seals 70 and 80 against the periphery of shank 45.

Our tests have indicated that if the outer periphery 62 of the body 61 is cylindrical throughout its length, there is a tendency for the internal pressure in chamber 82 to cause the body 61 to bulge in its central area. Therefore, we have found it to be extremely desirable, to provide a central reinforcing annular rib 100 which surrounds the outer central periphery of the body 61. The ends of the rib 100 join opposite outer sides of the collar 85 so as to reinforce the central chamber 82 to reduce appreciably the tendency of the body 61 two bulge in the central portion. This rib 100 protrudes outwardly, having complimentary converging upper and lower, outwardly tapering, surfaces 101 and 102 and an outer cylindrical surface 103 which joins the outer edges of the surfaces 101 and 102.

In use, the pipe 10 is rotated by the shaft 11 and is also pushed downwardly for driving the bit into the ground. Furthermore, after the bit has traveled any appreciable distance, drilling fluid is introduced under pressure of about 80 psi through pipe 89 and forced down through the drill pipe 12.

When the drill pipe 12 has been moved downwardly for a sufficient distance, it is necessary to install another section of pipe 12 onto the end of the first mentioned pipe. This is accomplished by stopping the rotation and downward pressure on shaft 11 and installing the handle 40 on the arm 33. Thereafter the handle 40 is rotated in a counterclockwise direction as viewed in FIG. 1, whereby the pipe 10 is loosened from the drill pipe 12 and the lower end of the pipe 12 is thus totally removed from the end of the drill pipe 12.

Next, the shaft 11 is raised sufficiently so that another section of drill pipe 12 can be inserted so that its external threads of its lower end are received in the internal threads of the first mentioned pipe 12. Next, the shaft 11 is rotated and lowered so that the threads 53 engage the upper end of this newly inserted drill pipe 12. The operation is then repeated as often as is necessary to pass successive drill pipes 12 into the ground. Of course, each time the shaft 11 is rotated, the handle 40 must be removed since the ratchet cap 30 rotates with shaft 11.

Sand or particles in the drilling fluid do not appear to destroy the seals 66, 76, 70 and 80 and even after about 10 hours of operation, there appeared to be no appreciable wear on these seals.

It will be obvious to those skilled in the art that many variations may be made in the embodiment here chosen for the purpose of illustrating the present invention wrthout departing from the scope thereof as defined by the appended claims.

I claim:

1. A ratchet and hydraulic seal assembly for transferring power from a rotating drive shaft to a drill pipe and for directing drilling fluid into the drill pipe comprising:

(a) a power transfer pipe, having at its upper end a ratchet member with circumferentially spaced teeth, a pawl for engaging said teeth, a rotatable cap carrying said pawl, means for rotating said cap to rotate through said pawl said power transfer pipe, a shank integrally joined to said ratchet member, said shank having a port and a hollow interior communicating with said port, and a tubular lower threaded end for receiving a drill pipe thereon, said hollow interior communicating with said drill pipe through said lower end;

(b) an elastomeric hydraulic seal assembly having a sleeve providing a chamber surrounding said shank, a collar communicating with said sleeve for introducing drilling fluid into said chamber for passage through said port and said hollow interior;

(c) said shank being provided with a pair of spaced circumferential grooves;

(d) said sleeve including seals on opposite ends of said chamber, surrounding said shank and received respectively in said grooves;

(e) said seal assembly being composed of an elastomer and a lubricant incorporated into said elastomer;

(f) said seals being in tension in said grooves;

(g) said sleeve including second seals surrounding said shank and inwardly of said first mentioned seals;

(h) said second seals protruding inwardly and seating with pressure of said drilling fluid against said shank; and (i) said ratchet member including a ring having a bore for receiving the end of said drive shaft and a shear pin securing said pipe to said drive shaft.

2. A ratchet and hydraulic seal assembly for transferring power from a rotating drive shaft to a drill pipe and for directing drilling fluid into the drill pipe comprising:

(a) a power transfer pipe, having at its upper end a ratchet member with circumferentially spaced teeth, a pawl for engaging said teeth, a rotatable cap carrying said pawl, means for rotating said cap to rotate through said pawl said power transfer pipe;

(b) a shank integrally joined to said ratchet member, said shank having a port and a hollow interior communicating with said port, and a tubular lower threaded end for receiving a drill pipe thereon, said hollow interior communicating with said drill pipe through said lower end; and (c) said ratchet member including a ring having a bore for receiving the end of said drive shaft and a shear pin securing said pipe to said drive shaft.

* * * * *